US005832884A

United States Patent [19]

Haas et al.

[11] Patent Number: 5,832,884

[45] Date of Patent: Nov. 10, 1998

[54] DEVICE AND METHOD FOR OPERATING A VALVE DRIVE OF AN INTERNAL COMBUSTION ENGINE

[75] Inventors: Michael Haas, Weisendorf; Walter Speil, Ingolstadt, both of Germany

[73] Assignee: Ina Wälzlager Schaeffler oHG, Herzogenaurach, Germany

[21] Appl. No.: 682,639

[22] PCT Filed: Jan. 26, 1995

[86] PCT No.: PCT/DE95/00088

§ 371 Date: Oct. 1, 1996

§ 102(e) Date: Oct. 1, 1996

[87] PCT Pub. No.: WO95/21992

PCT Pub. Date: Aug. 17, 1995

[30] Foreign Application Priority Data

Feb. 9, 1994 [DE] Germany ..... 44 04 145.4

[51] Int. Cl.[6] ..... F01L 13/00

[52] U.S. Cl. ..... 123/90.16; 123/90.48

[58] Field of Search ..... 123/90.15, 90.16, 123/90.17, 90.27, 90.48, 90.49, 90.5, 90.55

[56] References Cited

U.S. PATENT DOCUMENTS

| | | | |
|---|---|---|---|
| 4,167,931 | 9/1979 | Iizuka | 123/198 F |
| 4,509,467 | 4/1985 | Arai | 123/90.16 |
| 5,090,364 | 2/1992 | McCarroll et al. | 123/90.16 |
| 5,193,496 | 3/1993 | Kruger | 123/90.16 |
| 5,247,913 | 9/1993 | Manolis | 123/90.16 |
| 5,361,733 | 11/1994 | Spath et al. | 123/90.16 |
| 5,402,756 | 4/1995 | Bohme et al. | 123/90.16 |
| 5,555,861 | 9/1996 | Mayr et al. | 123/90.16 |
| 5,651,335 | 7/1997 | Elendt et al. | 123/90.16 |
| 5,655,487 | 8/1997 | Maas et al. | 123/90.16 |

FOREIGN PATENT DOCUMENTS

| | | |
|---|---|---|
| A 42 10 567 | 10/1992 | Germany . |
| 93 06 685 | 6/1993 | Germany . |
| U 9319435 | 2/1994 | Germany . |
| A- 43 14 619 | 11/1994 | Germany . |
| 60-1 11 009 | 6/1985 | Japan . |
| 61-2 01 807 | 9/1986 | Japan . |
| A 2 268 242 | 1/1994 | United Kingdom . |

*Primary Examiner*—Weilun Lo
*Attorney, Agent, or Firm*—Henry M. Feiereisen

[57] ABSTRACT

A switchable supporting component (30) is to be designed in such a way that a pull-rod engaging at one end (35) of it can be fully operatively separated from the control cam. The invention effects this in that in the housing (31) there runs at least one further radial drilling (37) aligned in a large cam movement phase in which there is a coupling component (49) movable along the drilling which, when the cam is disconnected from the pull-rod, can move in such a way that it laps over an annular gap (41) formed between the housing (31) and the cylinder head (10) and runs at the same time in the two drillings (37) in the housing (31) and the cylinder head (10). Thus, the idle stroke of the housing (31) necessary when the pull-rod is disconnected is avoided. Disconnection can take place even at medium to fast rotation speeds, since a pressure spring (47) no longer keeps the pull-rod in permanent contact with the cam via the housing (31) in the disconnection phase.

10 Claims, 9 Drawing Sheets

DEVICE AND METHOD FOR OPERATING A VALVE DRIVE OF AN INTERNAL COMBUSTION ENGINE

BACKGROUND OF THE INVENTION

The invention concerns a device for operating a valve drive of an internal combustion engine comprising a switching mechanism for switching to different valve lift curves of a gas exchange valve. The invention further concerns a method of operating a valve drive of an internal combustion engine.

Such switching mechanisms effect a reduction of friction in the valve drive especially at low to medium rotation speeds of the internal combustion engine by actuating only one of preferably two gas exchange valves in opening direction. However, since the switched-off element executes an idle stroke against the force of a spring, unnecessary friction still occurs on this element. In addition, the element in question is retained by the force of this spring on the control cam concerned. If, now, a switching-off is required at high rotation speeds, the spring used must be very strong but the limited design space restricts this possibility so that the maximum rotation speed of the internal combustion engine has also to be limited. Moreover, if the moment of time of re-switching is unfavorable, increasing noise and wear problems can occur.

SUMMARY OF THE INVENTION

The object of the invention is therefore to create a device and a method of the type initially cited avoiding the mentioned drawbacks while particularly enabling a disconnection of the cam follower from the cam with low friction even at medium to high rotation speeds and permitting a re-connection of the cam follower with low noise and wear.

The invention achieves this object according to the present invention by the fact that the switching mechanism is an integral part of, or supports a cam follower arranged in driving relationship between a camshaft and the gas exchange valve, the switching mechanism comprises a hollow cylindrical housing in whose interior extends an axially displaceable inner element which can be coupled thereto, the housing and the inner element each comprising at least one first radial or tangential bore or recess aligned in the base circle phase of the cam of the camshaft, said bore or recess houses at least one piston or pin which is displaceable in bore direction and serves as a coupling means which effects coupling by bridging an annular gap formed between the housing and the inner element, at least one further radial or tangential bore or recess aligned in a phase of maximum cam lift is arranged in the housing and in a surrounding structure in form of an outer casing, and at least one further coupling element displaceable in bore direction is arranged in said further bore or recess and, to effect an uncoupling of the cam follower from the cam, said further coupling element is displaced so as to bridge an annular gap formed between the housing and the surrounding structure while extending simultaneously into both bores or recesses. According to an alternative solution, the housing or the inner element comprises at least one further bore or recess axially spaced from the first bore or recess and into which, for disconnecting the finger lever from the cam, the piston or pin arranged in the facing component (inner element or housing) is displaceable in the phase of maximum cam lift so as to bridge an annular gap formed between the housing and the inner element.

The measures of the invention make it possible for the support element concerned to be uncoupled from the lifting contour of the control cam when a disconnection of the cam follower is desired. At the same time, the cam follower is out of driving relationship to the control cam so that the aforesaid detrimental friction losses are eliminated because the cam follower is thus only temporarily pressed against the control cam in case of uncoupling. The aforementioned further coupling element keeps the housing and the cam follower, which is force-locked on the housing, out of contact with the lifting movement of the control cam after the housing of the switching mechanism has executed an idle stroke. The disadvantageous idle stroke of the housing relative to the inner element encountered in the prior art is eliminated by the invention. The hitherto required strong restoring spring inside the mechanism is no longer necessary so that high speeds of rotation are possible even in an uncoupled state of the switching mechanism. It is both conceivable and intended to use the switching mechanism of the invention in all types of valve drives for internal combustion engines, for instance in known types of switching tappets and other switching elements. The invention also covers other means of applying force to the coupling and uncoupling elements such as for example, magnetic, electromagnetic, mechanical (eccentric), pneumatic and other means. In addition, all types of selective force application to the coupling elements (coupling by spring force and uncoupling by a hydraulic medium, or vice versa) are also included in the subject matter of the invention.

For a hydraulic application of force to the coupling elements, it is particularly advantageous to configure these as pistons. However, coupling can also be achieved with rolling elements in the form of balls, or with pins or wedges etc. In all embodiments, the hydraulic piston is used only as a pushing element for another coupling element which then effects a direct coupling between the housing and the inner element. The important feature for most of the embodiments is that the recesses for the coupling and the pushing elements are of a complementary shape to the elements.

Suitably, the cam follower is a known type cup-shaped tappet. The peripheral surface of the tappet comprises a control edge which cooperates with a wedge-shaped coupling element projecting from the cylinder head. In this embodiment, switchable tappets known from the prior art can also be used. All that is necessary is to provide a supply duct and a lodging for the wedge-shaped coupling in the cylinder head of the internal combustion engine.

To neutralize the forced driving disconnection between the housing and the control cam in order to achieve a coupling of the cup tappet to the control cam, the coupling element can be displaced radially outwards by a compression spring.

A simple variant of a forced driving disconnection of the cam follower from the control cam which embodiment does not comprise additional pistons to serve as coupling elements but the housing comprises at least one additional cam-proximate recess for the piston which is already present. Moreover, this and other embodiments of the invention also provide for a switching to partial strokes only of the control cam. These measures will not be described more closely here but they can be implemented by using axially spaced "coupling steps" in the switching element which, in this case, is made as a support element.

Advantageously, the hydraulic medium is routed through a supply duct of the surrounding structure in form of a cylinder head to a longitudinally extending annular gap which surrounds an outer peripheral surface of the housing at least in parts and communicates with bores intersecting the housing so that a radialy inward displacement of the piston or pin is enabled. However, it is also possible to apply force to the coupling elements simply through an oil supply duct.

In a further embodiment of the invention, the first and the further coupling element of the switching mechanism are arranged in the housing. The further coupling element cooperates in a radially outward direction with a recess of the cylinder head. The activation of both these coupling elements is effected simply by a supply duct in the cylinder head.

In accordance with an alternative solution of the present invention, the further coupling elements are arranged in the cylinder head and can be pressurized in coupling direction by the force of at least one compression spring. An uncoupling of the first and the further coupling elements is achieved again simply by means of a control supply duct arranged in the cylinder head. The compression spring in this example is a coil spring but it is conceivable to use any elements having a spring effect and which can be accommodated in the available design space. Such elements may be made of gas-filled elastomers or may alternatively be disc springs, conical springs or other similar machine components.

It is particularly advantageous to provide for an additional displacement of the housing in a cam-distal direction in case of uncoupling. This additional travel is realized by the simple measure of making a bevel in the bore into which the further coupling element is displaced for uncoupling. In this way, the support element effects a forced and complete disconnection of the finger lever from the cam contour so that even the minimum friction occuring due to a contact of the cam tip with the finger lever is eliminated by simple means.

A simple measure for establishing the necessary connection between the switching mechanism and the cam follower is recited in a further sub-claim. Other conceivable devices for connecting the switching mechanism to the cam follower are, for example, bayonet-type or interlocking means or other engaging means arranged on the finger lever.

Advantageously, the duct for the hydraulic control of the coupling elements can also be used for supply of hydraulic medium to a hydraulic clearance compensation element. The use of a common control duct in the switching element is advantageous but a separate supply of hydraulic medium to the clearance compensation element is also conceivable. At the same time, it is conceivable and within the scope of the invention to implement a purely hydraulic switching of the elements both in the coupling and uncoupling direction.

Preferably, at least one of the elements of the switching mechanism is made of a light weight and/or polymeric material. This measure further contributes to a reduction of weight and minimization of friction in the valve drive.

In accordance with the present invention includes a first operational state in which one element of the cam follower or of a support element thereof destined to effect a large valve lift is retained in a bottom dead center position at maximum cam lift while being uncoupled from one another of the cam follower or of the support element, and in a second operational state in which the uncoupled element of the cam follower of of the support element comes to abut against the cam in a return phase of the cam defined by a phase comprised between a maximum lift of the gas exchange valve at valve speed zero and a minimum lift of the gas exchange valve at valve speed of approximately zero. A method of operating a valve drive of an internal combustion engine. The method of the invention for re-coupling the previously uncoupled element to its cam guarantees a low-wear and low-noise establishment of contact. This re-coupling can be realized, for example, at maximum cam lift so that the required displacement of the element to be coupled is kept to a minimum. However, it is also possible to effect re-coupling starting at maximum cam lift and increasing cam speed. However, in this case, the restoring compression spring of the element must be designed so that the speed of the element is higher than the speed of the leading cam. A preferred phase for effecting re-coupling is the phase preceding the base circle phase of the cam. The cam then practically has a braking effect on the now abutting, previously uncoupled element.

The invention is not limited to the features of the claims. Rather, combinations of individual features of the claims with one another and with the disclosures contained in the description of advantages and examples of embodiments are both conceivable and intended.

BRIEF DESCRIPTION OF THE DRAWING

The invention is represented in the drawings in which.

DETAILED DESCRIPTION OF PREFERRED EMBODIMENTS

Figure 1:
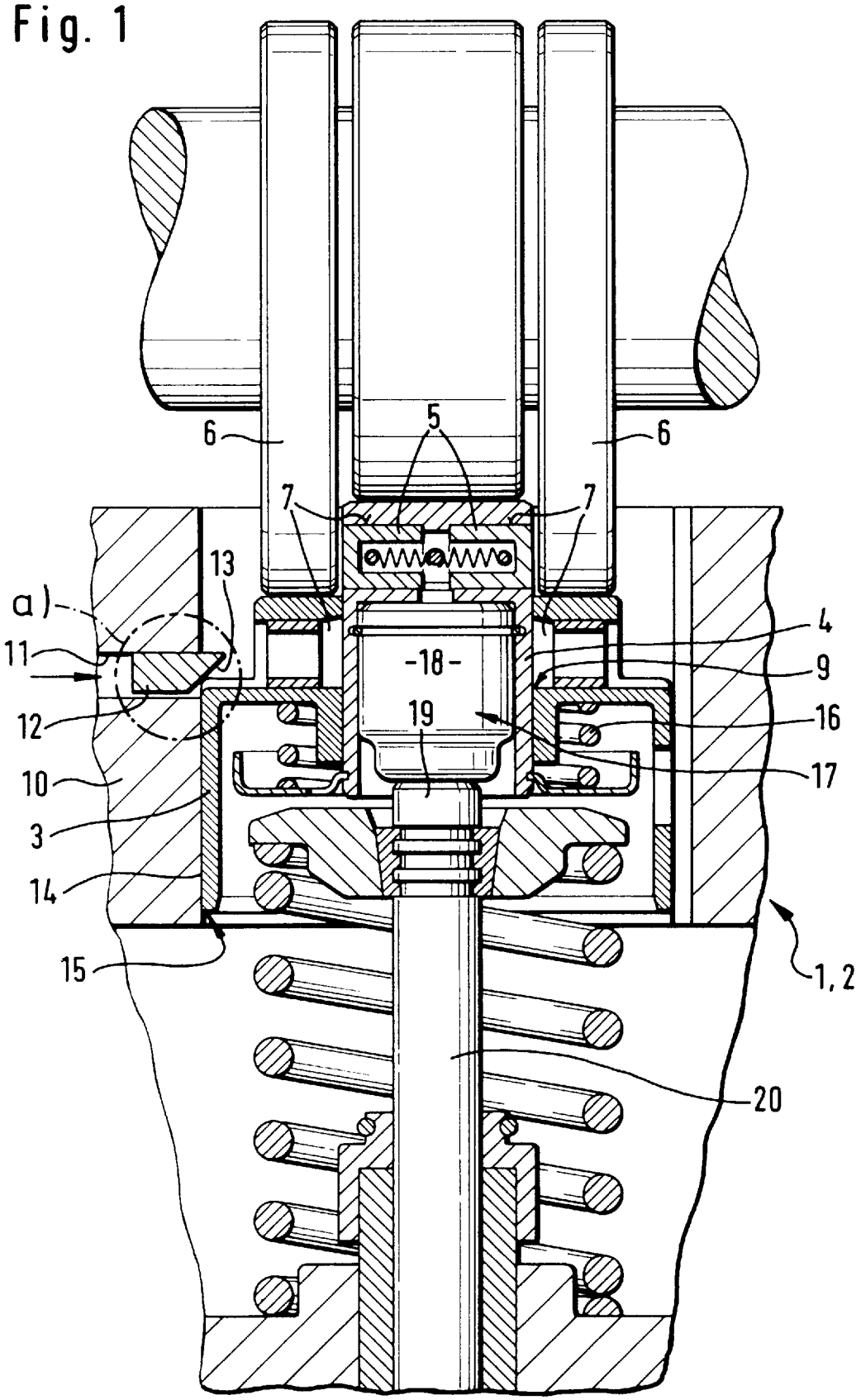
FIG. 1 is a longitudinal cross-section through a cup-shaped tappet.

FIG. 1 shows an embodiment of the switching mechanism 1 of the invention. The switching mechanism 1 is an integral part of a cam follower, in this case, in the form of a cup-shaped tappet 2. The tappet 2 comprises a housing 3 in which an inner element 4 is concentrically arranged. The inner element 4 is axially displaceable relative to the housing 3 and can be coupled thereto, in a base circle phase of the control cam 6, by coupling means in the form of first pistons 5, not specified, These pistons 5 extend in a first bore 7 of the inner element 4 and, in case of coupling in a base circle phase of the control cam 6, are displaced hydraulically into a first bore 7 of the housing 3 whereby they bridge an annular gap 9 formed between the housing 3 and the inner element 4.

A cylinder head 10 surrounding the housing 3 comprises a radially extending further bore 11 in which a radially inwards displaceable further coupling element 12 is positioned. If an uncoupling of the cup-shaped tappet 2 from the control cam 6 is desired, the coupling element 12 is displaced by hydraulic medium radially inwards in the bore 11 during a bottom dead center position of the housing 3 and engages a suitable recess in the housing 3. A radially inner end surface 13 of the coupling element 12 now extends beyond a peripheral surface 14 of the housing 3, i.e. it bridges an annular gap 15 formed between the housing 3 and the cylinder head 10. Due to this overlapping of the peripheral surface 14 of the housing 3 by the further coupling element 12, the housing 3 is "held back" from the control cam 6 in the uncoupled state of the switching mechanism 1. In this way, the compression spring 16 arranged in the housing 3 concentrically around the inner element 4 and which hitherto had the function of repositioning the inner element 4 relative to the housing 3, can be of smaller dimension or, in other words, the tappet 2 can be maintained in the uncoupled state even at medium to high rotation speeds of the internal combustion engine.

A hydraulic clearance compensation means 17, not specified, is arranged within the inner element 4. The pressure piston 18 of the hydraulic clearance compensation means 17 bears against an end 19 of a valve stem 20.

The structure and mode of functioning of the tappet 2 of the invention will not be described further since such tappets are well-known in the technical field.

Figure 2:
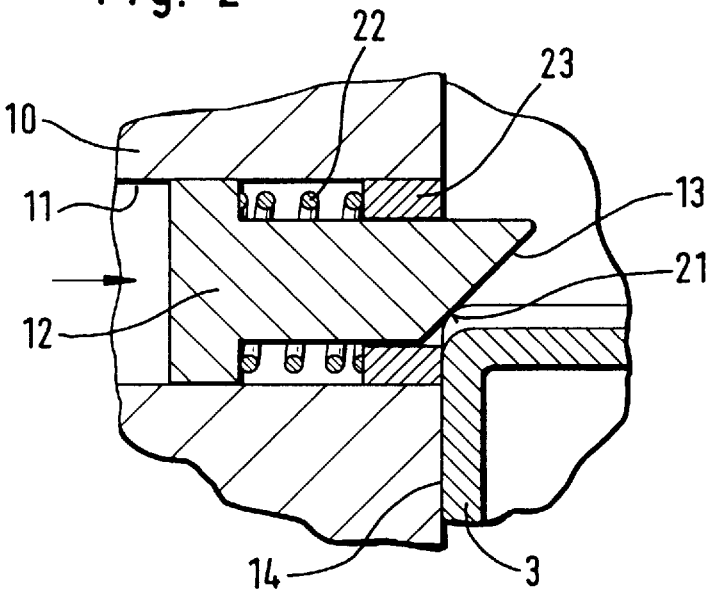
FIG. 2 shows a detail a) from FIG. 1.

FIG. 2 shows an enlarged detail a) from FIG. 1. As can be seen, the radially inner end surface 13 of the further coupling element 12 is configured as a plane inclined in valve direction. With this inclined plane, the further coupling element 12 cooperates with a facing control edge 21 arranged radially inward thereof on the peripheral surface 14 of the housing 3. When uncoupling of the cam follower 2 from the control cam 6 is desired, the inclined end surface 13 of the further coupling element 12 effects an additional travel of the housing 3 in cam-distal direction when the further coupling element 12 is displaced radially inwards. Thus, in this embodiment and in those of FIGS. 5, 7 and 8, the housing 3 is completely separated from engagement with the control cam 6 with the accompanying advantages already described. A re-positioning of the further coupling element 12 with falling hydraulic pressure can be assisted by a compression spring 22. This compression spring 22 is supported at a radially outer end on the further coupling element 12 and acts at a radially inner end on a ring 23 arranged around the further coupling element 12 in the further bore 11 of the cylinder head 10.

Figure 3:
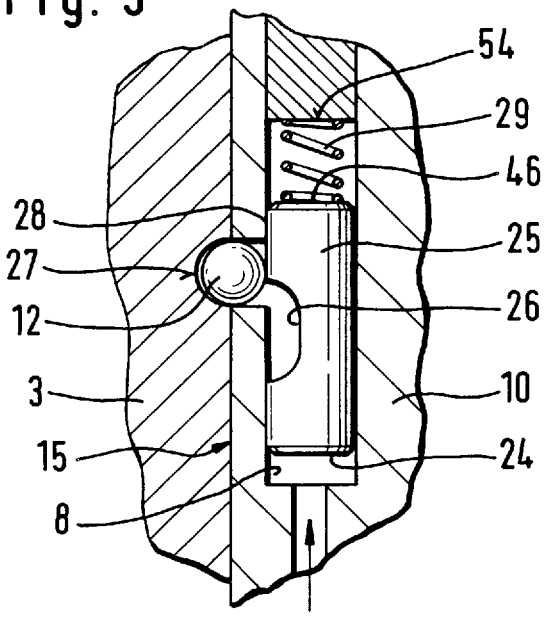
FIG. 3 shows an embodiment of an axial loading of the coupling element.

An alternative embodiment of the invention for a driving separation between the housing 3 and the control cam 6 is shown in FIG. 3. In this embodiment, an axially displaceable control element 25 (in this case, in the form of a hydraulic piston) exposed to hydraulic pressure at one front end 24 is arranged in the cylinder head 10 near the annular gap 15 formed between the housing 3 and the cylinder head 10. The control element 25 comprises a groove-shaped recess 26 facing the central axis of the switching mechanism 1. At the same time, a ball-shaped further coupling element 12 is shown in a spherical recess 27 of the housing 3. This coupling element 12 cooperates with the recess 26 of the control element 25 so that, to effect a desired uncoupling of the cam follower 2 from the control cam 6, the coupling element 12 is displaced radially inwards into the recess 27 by a peripheral surface 28 of the control element 25 whereby it bridges the annular gap 15 between the housing 3 and the cylinder head 10. To accomplish a desired coupling of the cam follower 2 to the control cam 6, the control element 25 is loaded by hydraulic pressure in opposition to the force of a compression spring 29 so that the further coupling element 12 comes to be located directly opposite the recess 26 into which it then locks. The compression spring 29 of this embodiment therefore acts in a coupling direction.

Figure 4A:
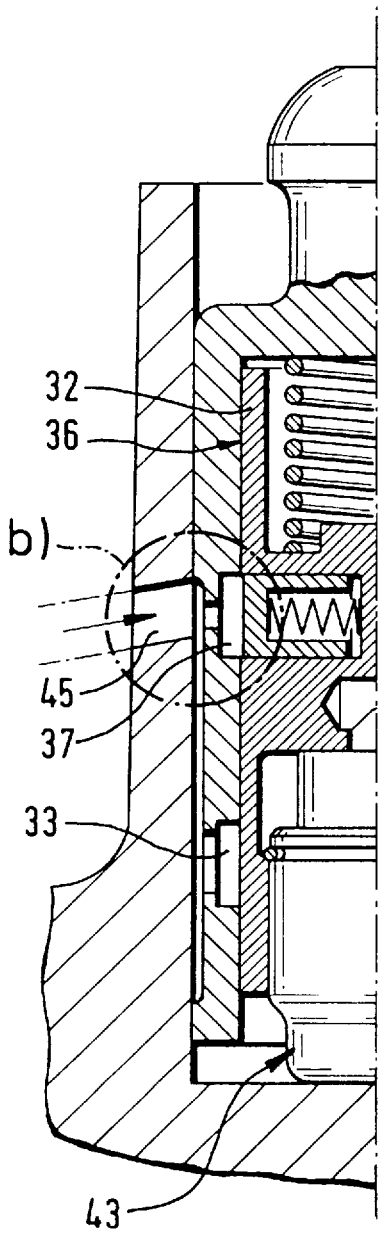
FIG. 4*a* shows a first embodiment of a switchable cam follower configured as a support element, illustrating the switching mechanism in a position in which the finger lever is uncoupled from the control cam.
Figure 4B:
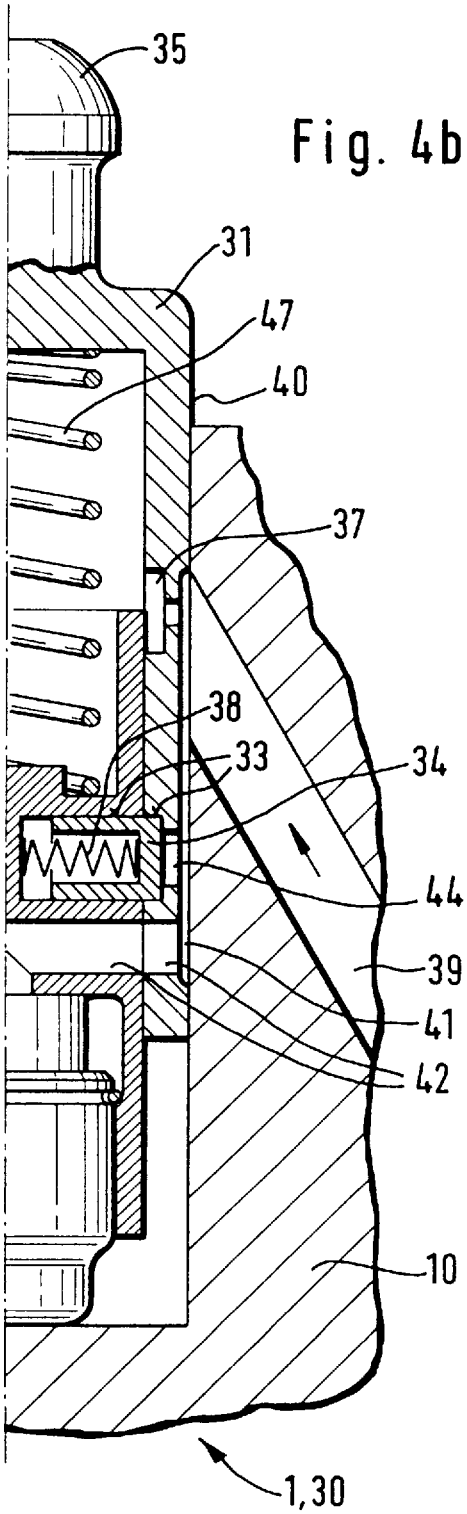
FIG. 4*b* shows the switching mechanism in a position in which the finger lever is coupled with the control cam.

FIGS. 4*a* and 4*b* show a further embodiment of the switching mechanism 1 of the invention configured in this case as a support element 30. This support element 30 comprises a hollow cylindrical housing 31 in which an axially dispaceable inner element 32 which can be coupled to the housing 31 is arranged. A first radial bore 33 aligned in a base circle phase of the cam, not shown, extends in the housing 31 and in the inner element 32. A first piston 34 which is displaceable in its own longitudinal direction and which serves as a first coupling element is arranged in this bore 33. In case of coupling of a finger lever 53 (see FIG. 9) supported on an end 35 of the housing 31 to a control cam, not shown, the piston 34 is displaced in the first bore 33 so that it bridges an annular gap 36 formed between housing 31 and the inner element 32.

The housing 31 comprises a further bore 37 (it is advantageous to provide two pistons 34 to engage into two bores 37) into which, to effect an uncoupling of the finger lever 53 from the control cam, the piston 34 is displaced out of the inner element 32 in the phase of maximum cam lift so as to bridge the annular gap 36 formed between the housing 31 and the inner element 32 (see FIG. 4*a*). A biasing in this coupling direction is achieved by the force of a compression spring 38 acting in radially outward direction on each piston 34. A re-positioning of the piston 34 is accomplished by hydraulic pressure.

Hydraulic medium is fed through a supply duct 39 arranged in the cylinder head 10. This supply duct 39 leads to a longitudinally extending annular gap 41 which surrounds at least parts of the peripheral surface 40 of the housing 31. In the base circle phase of the control cam, this annular gap 41 is intersected by a radial bore 42 extending through the housing 31 and the inner element 32. This bore 42 serves to assure a supply of hydraulic medium to a hydraulic clearance compensation means 43. The annular gap 41 is at the same time intersected at right angles by a further bore 44 through which hydraulic medium can act on the first coupling element 34. However, it is also conceivable and within the scope of the invention to provide a separate supply duct 45 in the cylinder head 10 for pressurizing the first piston 34 in the manner described above.

In FIG. 4*b*, the switching mechanism 1 is shown in the position in which the finger lever 53 supported thereon is retained in contact with the control cam. If, now, an uncoupling of the finger lever 53 from the contacting cam is desired, the pressure of hydraulic medium in the supply duct 39 is raised so that the piston 34 is displaced radially inwards. The housing 31 now performs an idle stroke in a cam-distal direction. At the physical limit of the stroke of the housing 31, the further bore 37 of the housing 31 registers with the first piston 34 (FIG. 4*a*). If, in the meantime, the hydraulic medium pressure has been reduced, the first piston 34 is displaced by the compression spring 38 into this further bore 37. In this way, the finger lever 53, not shown, is separated by force from the travel of the control cam. If this separation is wished to be neutralized, the hydraulic medium pressure can be raised via the supply duct 39, or 45, so that the first piston 34 is displaced radially inwards and the housing 31 is moved towards the cam by the force of a compression spring 47. When the upper dead center position of maximum axial displacement of the housing 31 relative to the inner element 32 is reached, the piston 34 locks into the first bore 33 of the housing 31 which is now situated opposite thereto provided the pressure of the hydraulic medium has been limited therebefore. The switching element 1 now functions in the manner of conventional support elements. The finger lever 53 follows the contour of the control cam so that the gas exchange valve concerned opens, and a required gas exchange cross-section opening into a combustion chamber is released. Since the basic principle of operation of the support element 30 of the invention is similar to that of the support elements of FIGS. 6 and 8, it will not be elaborated again when describing these figures.

Figure 5:
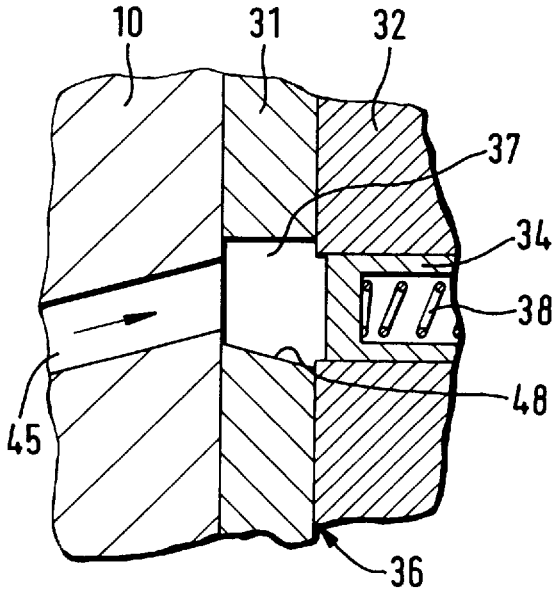
FIG. 5 is a fragmentary, sectional illustration of detail b) in FIG. 4*a* to show a means for an additional stroke travel of the housing of FIG. 4*a,*

FIG. 5 shows an enlarged detail b) from FIG. 4*a* illustrating means for an additional travel of the housing 31 in a cam-distal direction analogous to that of FIG. 2. For a desired uncoupling of the finger lever 53 from the cam, the further bore 37 of the housing 31 comprises a bevel 48. Upon a radially outward displacement of the first piston 34 into the further bore 37, when it bridges the annular gap 36, the housing 31 effects an additional travel in cam-distal direction so that the housing 31 and the finger lever 53 are completely out of engagement with the control cam.

Figure 6A:
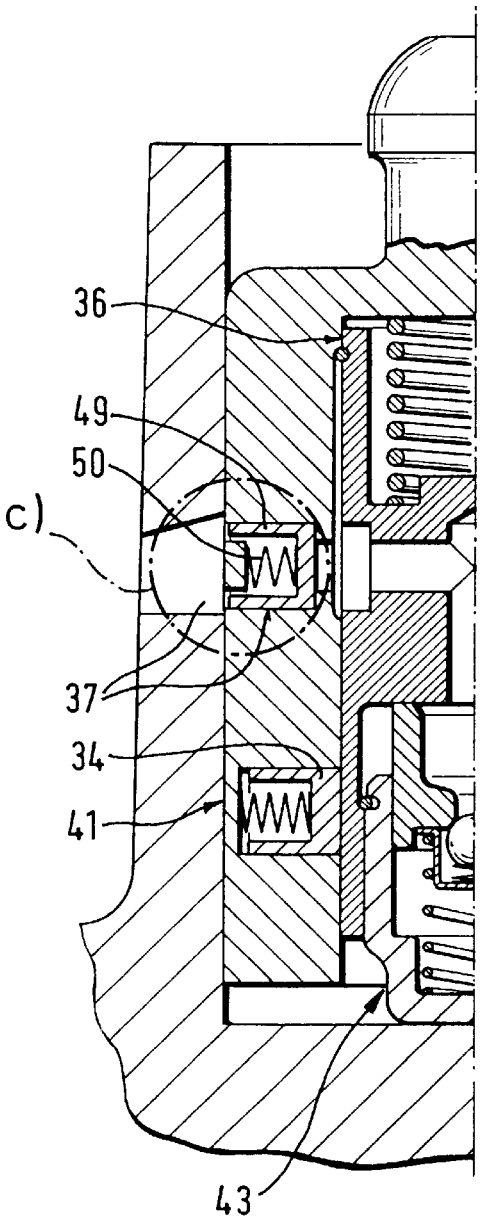
FIGS. 6*a* and 6*b* show another support element, similar to that of FIGS. 4*a*, 4*b,*
Figure 6B:
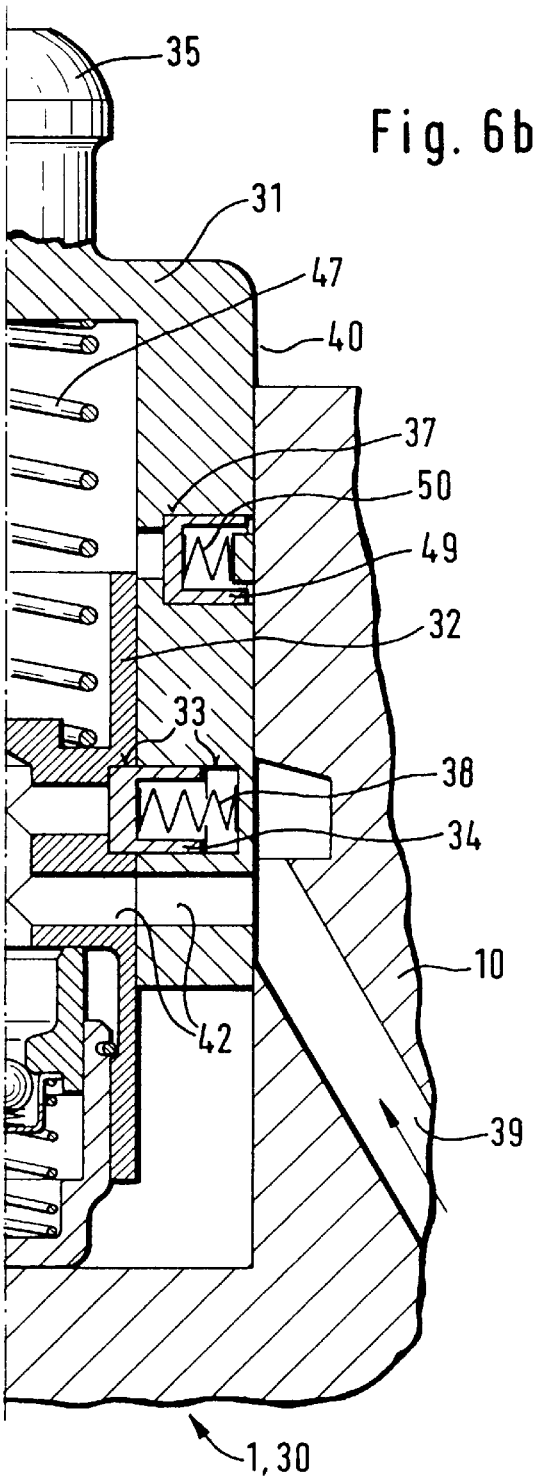

In the embodiment of FIG. 6*a* and 6*b*, at least one further piston 49 is provided in the support element 30 for uncoupling the finger lever 53 from the control cam. This further piston 49 is positioned in the further bore 37 of the housing 31. For uncoupling the finger lever 53 from the cam, the piston 49 engages into the further bore 37 of the cylinder head against the force of at least one compression spring 50 which biases it in a restoring direction. The further bores 37 of the housing 31 and the cylinder head are aligned in the phase of maximum cam lift when the support element 30 is unlocked so that the further piston 49 is displaced against the force of the compression spring 50, by the pressure of hydraulic medium applied through the bore 42, into the further bore 37 of the cylinder head 10 so as to bridge the annular gap 41 formed between the housing 31 and the cylinder head 10.

Hydraulic medium is again fed through the supply duct 39 in the cylinder head 10 to the housing 31. A bore 42 extending through the housing 31 and the inner element 32 registers with the supply duct 39 in the base circle phase of the cam when the support element 30 is unlocked. If now, an uncoupling of the finger lever 53 from the control cam is desired, the pressure of hydraulic medium in the supply duct 39 is raised (see FIG. 6*b*). This displaces the first pistons 34 out of engagement with their first bores 33 in the inner element 32. The housing 31 performs an idle stroke in cam-distal direction. When the bottom dead center position of this idle stroke of the housing 31 has been reached, the further piston 49 which extends in the housing 31 comes to be located radially opposite the further bore 37 of the cylinder head 10. The further piston 49 is now displaced radially outwards against the force of the compression spring 38 by the pressure of hydraulic medium into the further bore 37 so as to bridge the annular gap 41 between the cylinder head 10 and the housing 31. Thus, again, uncoupling in accordance with the invention is achieved. To neutralize this uncoupling, the pressure of the hydraulic medium is reduced so that the further piston 49 is displaced radially inwards by the compression spring 50.

Figure 7:
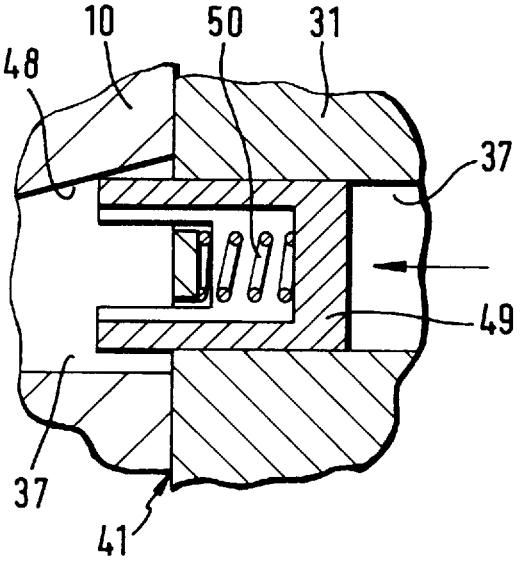
FIG. 7 shows a detail c) from FIG. 6*a,*

FIG. 7 shows an enlarged detail c) from FIG. 6*a* illustrating a means for an additional travel of the housing 31 in cam-distal direction analagous to that of FIGS. 2 and 5.

Figure 8A:
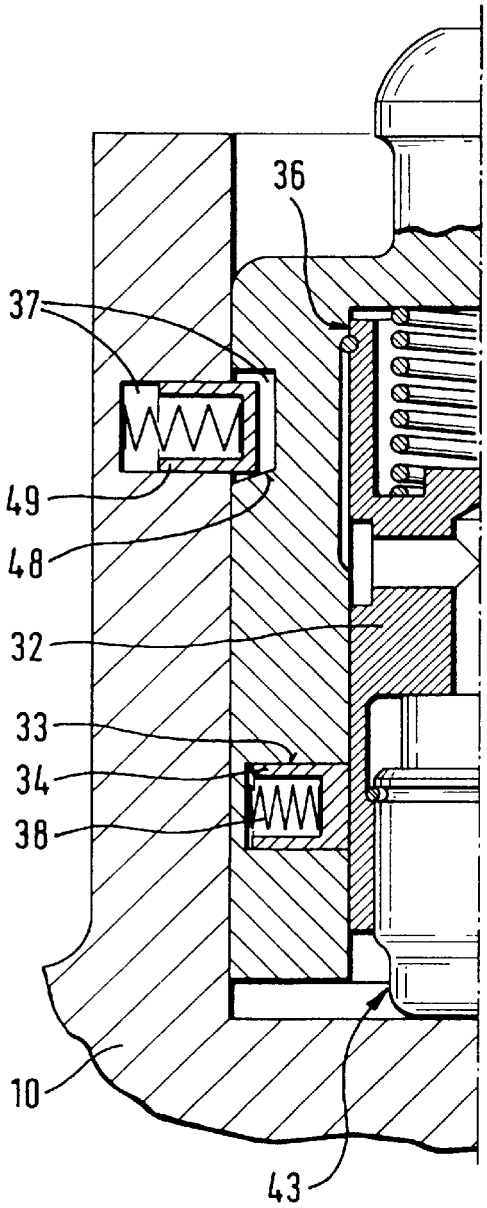
FIGS. 8*a* and *b* show two illustrations of a further embodiment of a switchable support element in coupled and uncoupled state.
Figure 8B:
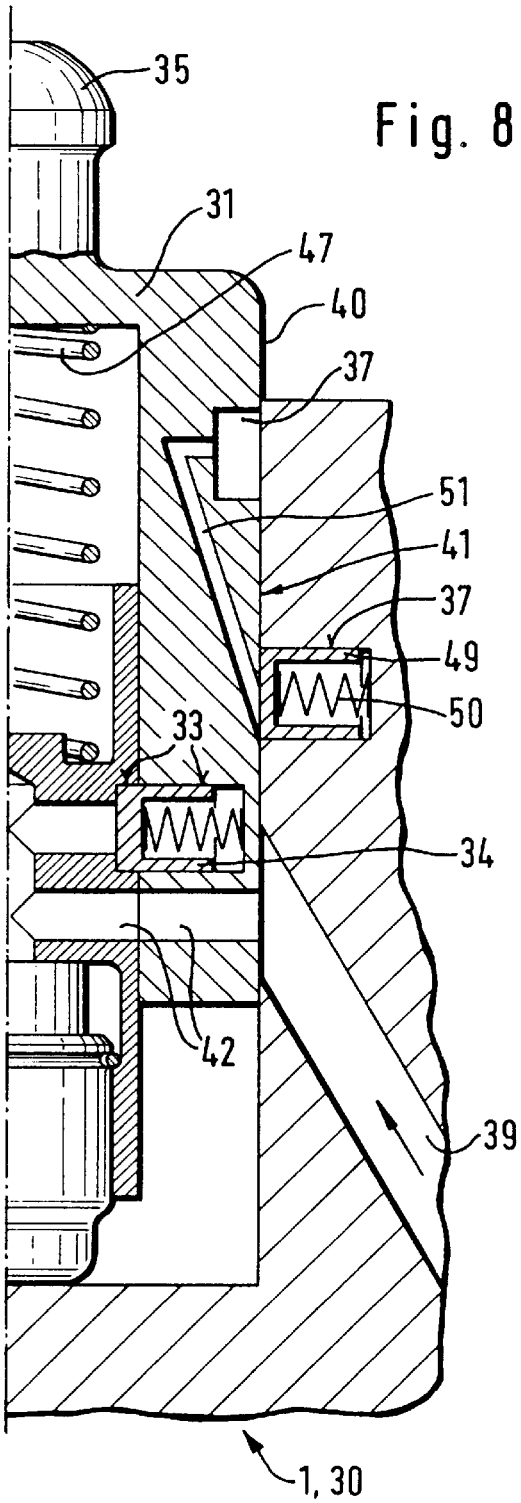

FIGS. 8*a* and 8*b* show a support element 30 similar to the support elements disclosed in FIGS. 4 and 6. The further piston 49 is arranged in the further bore 37 of the cylinder head 10. As described in several examples above, to effect uncoupling, this piston 49 is displaced radially inwards by the force of the compression spring 50 into the further bore 37 of the housing 31. A re-positioning of the further piston 49 is achieved in this case by means of a supply duct 51 arranged in the housing 31 at a slight inclination to the central longitudinal plane of the switching mechanism 1. This duct 51 opens into the duct 39 of the cylinder head at least in the phase of maximum cam lift in the uncoupled state of the support element 30. To effect an uncoupling of the housing 31 from the cylinder head 10, the pressure of hydraulic medium in the supply duct 39 is raised and the further piston 49 is displaced against the force of of its compression spring 50 radially outwards into the recess 37. The housing 31 performs a stroke in direction of its upper dead center position and is assisted therein by the compression spring 47. In this position, the first bores 33 of the housing 31 and the inner element 32 are aligned so that the first piston 34 is displaced partially out of its first bore 33 in the housing 31 into the first bore 33 in the inner element 32 so that the piston 34 bridges the annular gap 36 between the housing 31 and the inner element 32. The switching mechanism 1 now works as a conventional support element 30.

Figure 9:
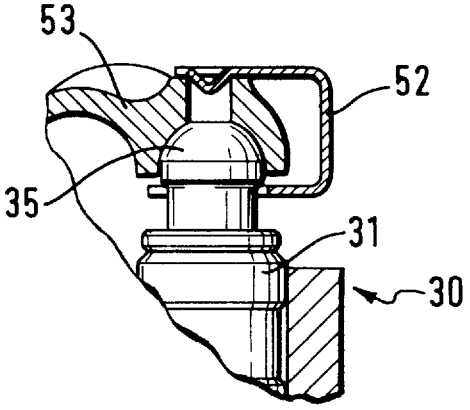
FIG. 9 is a partial view of a switching mechanism of the invention comprising means for coupling it to the cam follower.

From FIG. 9 it can be seen that the support element 30 is connected to the associated finger lever 53 by a clasplike connection 52. Due to this connection 52, a driving separation of the finger lever 53 from its associated control cam is accomplished upon uncoupling.

Figure 10:
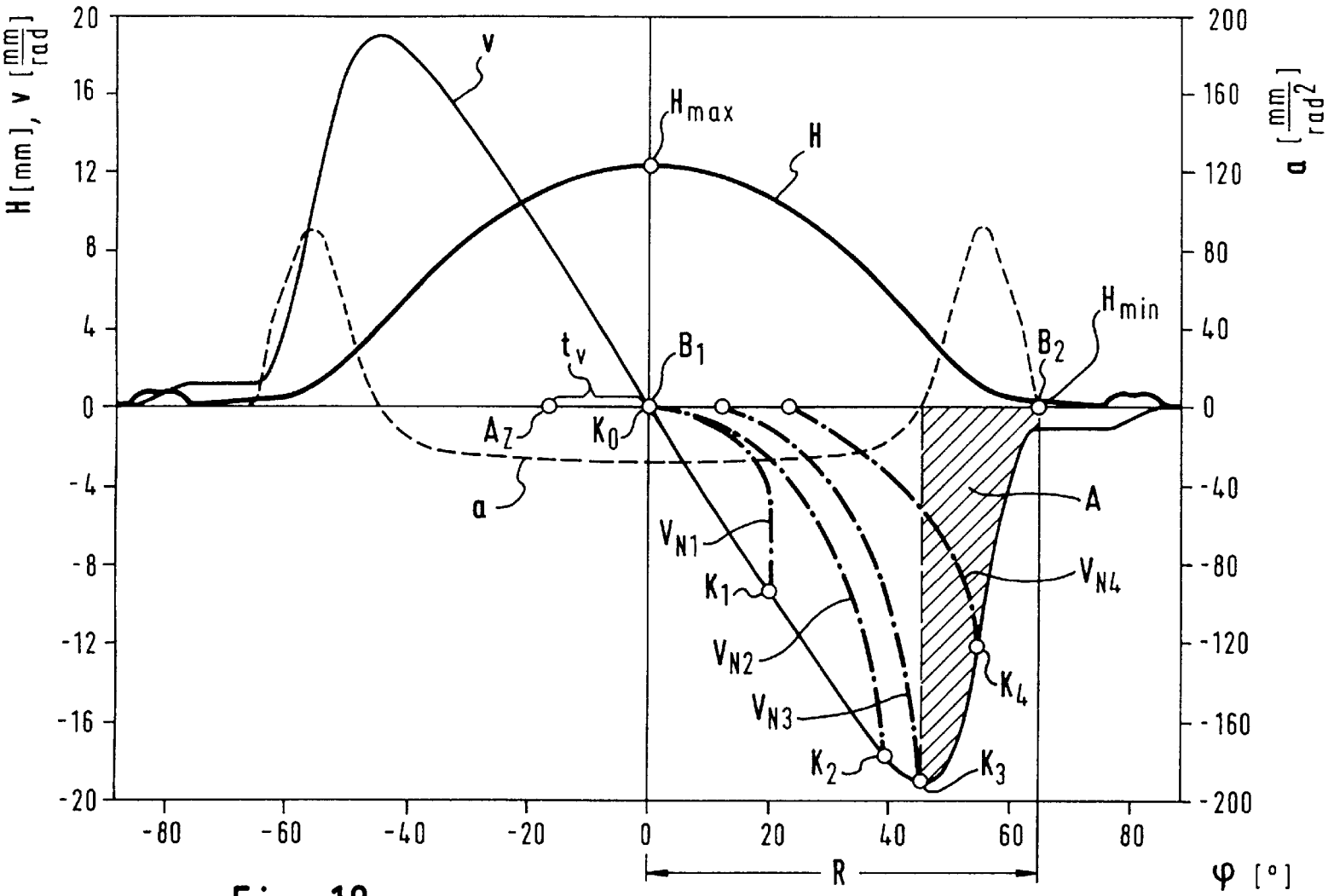
FIG. 10 is a diagram showing graphical curves of preferred phases for a re-coupling of the uncoupled element.

FIG. 10 is a diagram showing preferred phases for re-coupling. $K_0$ to $K_4$ are the possible points of time of impact of the lagging cam follower on the cam. As can be seen from the curves, it is desirable for these two elements to have the same or only slightly differing speeds at the time of impact. With consideration to system-inherent delays, re-coupling can be started earlier depending on the speeds of rotation. If the uncoupled element is moved toward the control cam in the phase A, its compression spring must only be so strong that the same speeds exist at the time of impact.

What is claimed is:

1. A device for operating a valve drive of an internal combustion engine, including a switching mechanism for switching to different valve lift curves of a gas exchange valve and incorporated in a cam follower which is disposed in driving relationship between a camshaft and the gas exchange valve, said device comprising:

an outer casing;

a hollow cylindrical housing received in the outer casing and defining an interior, said outer casing and said housing defining at their interface a first annular gap;

an inner element axially displaceable in the interior of the housing and capable of being coupled thereto, said housing and said inner element defining at their interface a second annular gap;

a first coupling element in the form of a piston displaceably received in a first radial bore arrangement comprised of one bore formed in the housing and another bore formed in the inner element, said bores of the first bore arrangement being aligned in a base circle phase of a cam arrangement of the camshaft for allowing the first coupling element to bridge the second annular gap for coupling the housing and the inner element to one another, said first coupling element being directly acted upon by a hydraulic medium for movement in one direction of displacement for coupling action and being spring-biased for loading in opposite direction of displacement;

second coupling means including a second coupling element displaceably received in a second radial bore arrangement comprised of one bore formed in the housing and another bore formed in the outer casing, said bores of the second bore arrangement being aligned in a phase of maximum cam lift for allowing the second coupling element to bridge the first annular gap and thereby effect an uncoupling of the housing and the inner element from the cam arrangement while the first coupling element extends entirely within one or the other bore of the first bore arrangement.

2. The device of claim 1 wherein the housing defines an axis, said second coupling means including an axially displaceable control element arranged in the outer casing near the first annular gap and having one end face acted upon by a hydraulic medium, said control element exhibiting a recess extending in direction of the axis for displacing the second coupling element in radially inward direction so as to bridge the first annular gap.

3. The device of claim 2 wherein the outer casing has formed therein a bore defining a bottom, said control element being provided in the form of a hydraulic piston which is received in the bore of the outer casing and has another end face acted upon by a compression spring extending between the other end face and the bottom.

4. The device of claim 1 wherein the cam follower is formed as cup-shaped tappet and the outer casing represents a cylinder head, said second coupling element being so displaceable in the second bore arrangement in a radially inward direction by hydraulic medium as to at least partially bridge a peripheral surface of the housing and thereby uncouple the tappet from the cam arrangement.

5. The device of claim 4 wherein the second coupling element has a radially inner end face exhibiting a plane inclined in valve direction for cooperation with a complementary control edge of the peripheral surface of the housing.

6. The device of claim 4 wherein the second coupling means includes a compression spring for loading the coupling element to seek a position in opposition to the force exerted by hydraulic medium.

7. The device of claim 1 wherein the cam follower includes a hydraulic clearance compensation unit.

8. The device of claim 1 wherein at least one component selected from the group consisting of housing and inner element is made of a light-weight or polymeric material.

9. The device of claim 2 wherein the second coupling element is a rolling element.

10. A method of operating a valve drive of an internal combustion engine of a type including a switching mechanism for switching to different valve lift curves of a gas exchange valve, with the switching mechanism cooperating with a cam follower arranged in driving relationship between a camshaft and a gas exchange valve and having a first element for effecting a large valve lift and a second element for effecting a small valve lift, said method comprising the steps of:

so retaining in a first operational state the first element in a bottom dead center position at maximum cam lift as to disengage from the cam while being uncoupled from the second element; and returning in a second operational state the first element, disengaged from the cam and uncoupled from the second element, for abutment against the cam in an area along a cam flank section during which the gas exchange valve closes in a range from a maximum valve lift to a minimum valve lift.

* * * * *